US010495046B2

(12) United States Patent
Kemptner

(10) Patent No.: US 10,495,046 B2
(45) Date of Patent: Dec. 3, 2019

(54) IGNITION DEVICE FOR AN EXTRANEOUSLY IGNITING COMBUSTION PISTON ENGINE

(71) Applicant: Andreas Kemptner, Unterhaching (DE)

(72) Inventor: Andreas Kemptner, Unterhaching (DE)

( * ) Notice: Subject to any disclaimer, the term of this patent is extended or adjusted under 35 U.S.C. 154(b) by 0 days.

(21) Appl. No.: 15/258,637

(22) Filed: Sep. 7, 2016

(65) Prior Publication Data

US 2017/0082080 A1 Mar. 23, 2017

(30) Foreign Application Priority Data

Sep. 23, 2015 (DE) ..... 10 2015 218 314

(51) Int. Cl.

| | |
|---|---|
| ***F02P 3/01*** | (2006.01) |
| *H01T 13/54* | (2006.01) |
| *F02F 1/24* | (2006.01) |
| *F02B 75/04* | (2006.01) |
| *F02P 13/00* | (2006.01) |
| *F02B 19/12* | (2006.01) |

(52) U.S. Cl.

CPC ..... *F02P 3/01* (2013.01); *F02B 19/12* (2013.01); *F02B 75/04* (2013.01); *F02F 1/24* (2013.01); *F02P 13/00* (2013.01); *H01T 13/54* (2013.01)

(58) Field of Classification Search

CPC .... F02P 3/01; F02P 13/00; F02P 15/04; F02P 15/06; H01T 13/08; H01T 13/50; H01T 13/54; H01T 13/20; F02B 19/12

USPC ..... 123/193.5, 647, 671, 169 MG

See application file for complete search history.

(56) References Cited

U.S. PATENT DOCUMENTS

| | | | | |
|---|---|---|---|---|
| 1,342,421 | A * | 6/1920 | Chapman | H01T 13/16 137/614.2 |
| 1,989,670 | A * | 2/1935 | Anthony | H01T 13/32 313/139 |
| 2,129,319 | A * | 9/1938 | Gants | F02F 1/365 123/143 R |
| 4,432,323 | A * | 2/1984 | Iwasaki | F02P 3/01 123/406.66 |
| 4,841,925 | A * | 6/1989 | Ward | F02P 3/0884 123/143 B |
| 5,014,656 | A * | 5/1991 | Leptich | H01T 13/32 123/169 EL |
| 5,720,252 | A * | 2/1998 | Blodgett | F02P 15/02 123/163 |
| 6,257,199 | B1 * | 7/2001 | Kanda | F02B 17/005 123/298 |
| 6,494,178 | B1 * | 12/2002 | Cleary | F02B 23/104 123/193.6 |
| 2003/0089325 | A1 * | 5/2003 | Marforio | F02P 15/04 123/159 |

(Continued)

*Primary Examiner* — Grant Moubry
*Assistant Examiner* — Joshua Campbell
(74) *Attorney, Agent, or Firm* — Hayes Soloway PC

(57) ABSTRACT

An ignition device for an extraneously igniting combustion piston engine with an ignition chamber located between a cylinder head and a piston, wherein the cylinder head has an end surface which defines the ignition chamber and which is at least partially formed as a cylinder head electrode, and wherein an ignition chamber electrode is disposed within the ignition chamber and forms an ignition gap with the cylinder head electrode.

14 Claims, 1 Drawing Sheet

(56) References Cited

U.S. PATENT DOCUMENTS

| | | | | |
|---|---|---|---|---|
| 2006/0070603 | A1* | 4/2006 | Stanton | F02B 23/0651 123/298 |
| 2007/0209634 | A1* | 9/2007 | Minami | F02P 5/00 123/310 |
| 2007/0240670 | A1* | 10/2007 | Adams | F02F 1/40 123/193.3 |
| 2008/0135007 | A1* | 6/2008 | Storm | F02B 23/0654 123/143 C |
| 2010/0326388 | A1* | 12/2010 | Storm | F02B 23/0654 123/143 B |
| 2011/0073597 | A1* | 3/2011 | Hutchins | B01D 19/0036 220/203.01 |
| 2014/0261257 | A1* | 9/2014 | Williams | F01P 9/02 123/41.44 |
| 2017/0276110 | A1* | 9/2017 | Ikeda | F02M 57/06 |

* cited by examiner

IGNITION DEVICE FOR AN EXTRANEOUSLY IGNITING COMBUSTION PISTON ENGINE

CROSS-REFERENCE

This application claims priority to German Patent Application No. PA 2015218314 filed Sep. 23, 2015, the contents of which are incorporated herein by reference.

BACKGROUND

The invention relates to an ignition device for an extraneously igniting combustion piston engine and a combustion piston engine with such an ignition device.

In current extraneously igniting combustion piston engines such as in particular the spark-ignited engines used in motor vehicle construction, the combustion of the petrol-air mixture normally starts from substantially one point, e.g. from the ignition point of a spark plug. The ignition gaps of such spark plugs are extremely small, in particular in order to keep the necessary ignition voltage low. However, such construction designs mean that the combustion of the petrol-air mixture spreads substantially from a point of a clearly larger ignition chamber of the cylinder and possibly—particularly in the case of high engine speeds—the combustion process is not concluded when the mixture is blown out of the cylinder.

By reason of the associated incomplete combustion of the mixture in the cylinder, the entire heating value of the mixture cannot be converted into torque, which has a negative influence on the degree of efficiency of the engine. In addition, the exhaust tract subjected to heavy thermal loading by reason of afterburning processes, whereby more intensive demands are placed on the design of this exhaust tract in terms of installation space and/or cost, especially with respect to the cooling thereof and/or separate heat protection measures.

In order to remedy this problem, in the past "spark-to-piston" designs for spark-ignited engines have been proposed, in which the ignition gap is formed by an electrode on the cylinder head and an electrode on the piston. However, the longer ignition gap associated therewith requires a clearly higher ignition voltage than for commercially available spark plugs, which voltage then must also be present at the electrode on the piston. However, this means that complex electrical isolation of the piston is required, which is difficult to achieve by reason of the components of the piston guide which are moved in a highly dynamic manner with respect to each other. In any case, such isolation is associated with high costs and possibly with compromises in terms of other performance parameters.

SUMMARY

The object of the present invention is to provide an ignition device for such an engine, which permits efficient combustion of the petrol-air mixture in the ignition chamber, with efficient electrical isolation.

This object is achieved by an ignition device in accordance with the invention for an extraneously igniting combustion piston engine with an ignition chamber located between a cylinder head and a piston, in which the cylinder head has an end surface which defines the ignition chamber and which is at least partially formed as a cylinder head electrode, and in which an ignition chamber electrode is disposed within the ignition chamber and forms an ignition gap with the cylinder head electrode.

The invention is based on the fundamental idea of using the ignition chamber formed between the cylinder head and the piston to a greater extent for the formation of an ignition gap than is the case with conventional spark plugs. This requires, in particular, the placement of one of the electrodes relatively far away from the cylinder head in the direction of the piston in the ignition chamber. The ignition chamber is thus the dead space remaining between the cylinder head and the piston crown when the piston is located in its top dead centre (or in the vicinity of the top dead centre). Such an ignition chamber electrode is advantageously disposed as close as possible to the top dead centre of the piston in order to permit the greatest possible ignition gap. By means of such an ignition device a long ignition gap can be provided without having to include moved parts of the piston or of the piston inlet in an insulator of the required ignition voltage which is relatively high in accordance with the invention. In this way the power loss of an engine which occurs can be less than in the case of a conventional construction, which can reduce the necessary cooling and can be associated with lower expected petrol consumption for the same performance.

An end surface of the cylinder head can, in terms of the invention, be disposed radially (with respect to the central axis of movement of the piston) within apertures for an inlet valve and/or an outlet valve, but can also be disposed outside and/or surrounding this/these.

In order to contain or fix the starting point of the ignition gap on the cylinder head side in a spatially more precise manner, in accordance with one development, the end surface of the cylinder head in the region of the cylinder head electrode comprises a protrusion into the ignition chamber. The protrusion can be of different forms in adaptation to other geometrical properties, for example substantially conical, cylindrical, cuboidal and/or tubular. This development is based on the idea that the ignition gap is formed between the points of minimal spacing between the two electrodes.

According to one development the ignition gap makes up at least one quarter of the extent of the ignition chamber along a movement axis of the piston, in order to permit a large ignition gap and therefore rapid and rapidly starting combustion of the petrol-air mixture.

According to one development, this effect can be further intensified in that the ignition chamber electrode is disposed closer to the top dead centre of the piston than it is to the cylinder head electrode.

In order to maximise the ignition gap theoretically provided in the ignition chamber, in accordance with one development, the ignition chamber electrode is disposed on a bounding surface of the ignition chamber, which is defined by the top dead centre of the piston.

In accordance with one development, the ignition gap can be adapted to conditions within the cylinder, in that the ignition chamber electrode is formed to match an upper piston end surface. If, e.g., a piston end surface facing the ignition chamber is conical, in accordance with this development a conical ignition chamber electrode is provided which is preferably formed lying against the bounding surfaced defined by the top dead-centre of the piston.

In order to hinder the injection and combustion of the petrol-air mixture as little as possible, in accordance with one development the ignition chamber electrode is formed as a grid. The grid preferably has interlaced bars made of a conductive material, the diameter of which is smaller by a multiple than the spaces formed between the interlaced bars.

In relation to the invention, the term grid is understood to mean in particular arrangements in which, with respect to the entire surface area of the ignition chamber electrode, the proportion of the surface taken up by conductive material is smaller by a multiple than the proportion formed by the surface area of the spaces. Electrode materials which are familiar to the person skilled in the art are considered in particular as the conductive material for the electrodes.

In modern motor vehicles—with respect to the movement axis of the piston—the remaining ignition chamber between the top dead-centre of the piston and the end surface of the cylinder head is kept relatively small for reasons of efficiency. In order to be able to provide an ignition device even in such cases, in accordance with one development the ignition chamber electrode has at least one aperture for an inlet valve and/or an outlet valve of the internal combustion engine. It is thereby ensured that the stroke of the inlet valve and/or outlet valve does not have to be adapted to the geometry of the ignition chamber electrode.

In order to achieve a variable design for the ignition gap, which is adapted to the conditions in the cylinder, in accordance with one development the ignition chamber electrode is formed to match the cylinder head electrode, in particular in such a way that each point of the ignition chamber electrode oriented towards the ignition gap is at substantially the same distance to a corresponding point of the cylinder head electrode. In the case of such a design of the ignition device, e.g. the smallest manufacturing tolerances and/or a variable random distribution of a higher proportion of petrol in the injected petrol-air mixture can turn the balance between which point of the cylinder head electrode on the one hand and the ignition chamber electrode on the other hand the ignition gap is formed.

In the case of the arrangement of an ignition chamber electrode in the ignition chamber, which is, in particular, non-electrically connected to the piston, the ignition chamber electrode must be connected to a high voltage source by means of a supply line through a cylinder wall or a cylinder head wall or through a connecting point of the cylinder head and of the cylinder. In addition, this supply line must be electrically isolated with respect to said components.

In order to ensure this, in accordance with one development the ignition chamber electrode is connected to a high voltage source by means of a supply line disposed on the cylinder head and electrically isolated with respect thereto. The supply line of the ignition chamber electrode advantageously extends through the cylinder head electrode. However, the supply line can also extend at other points of the cylinder head.

In accordance with an alternative development thereto, the supply line of the ignition chamber electrode is disposed at a connecting point of the cylinder head and cylinder body, whereby reliable isolation is achieved which requires no substantial adaptations of the form of the cylinder head and/or of the cylinder body.

In accordance with a further aspect of the invention, a combustion piston engine is created which has an ignition device in terms of the invention.

BRIEF DESCRIPTION OF THE DRAWINGS

Advantageous embodiments of the invention will become clear from the dependent claims, advantageous embodiments will become clear from the following descriptions in conjunction with the figures. The figures show in detail:

DETAILED DESCRIPTION

Figure 1:
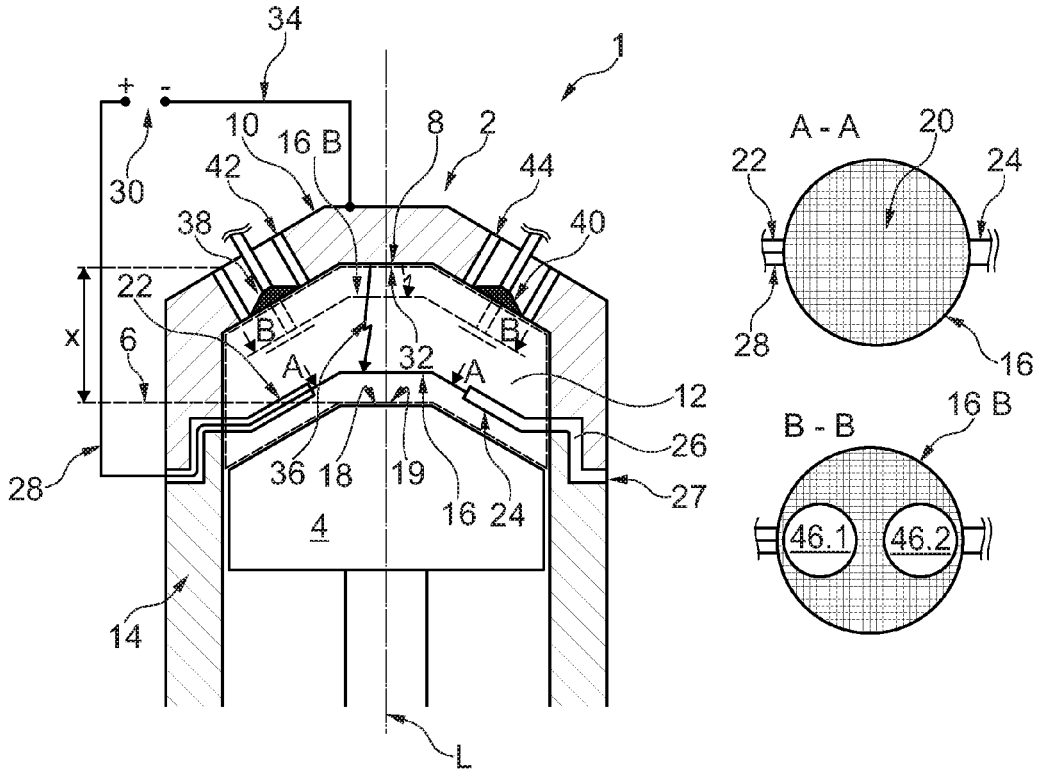
FIG. 1 is a schematic cross-sectional view of an ignition device with an ignition chamber electrode, formed to match the upper piston end surface, in accordance with a first embodiment of the invention.
Figure 2:
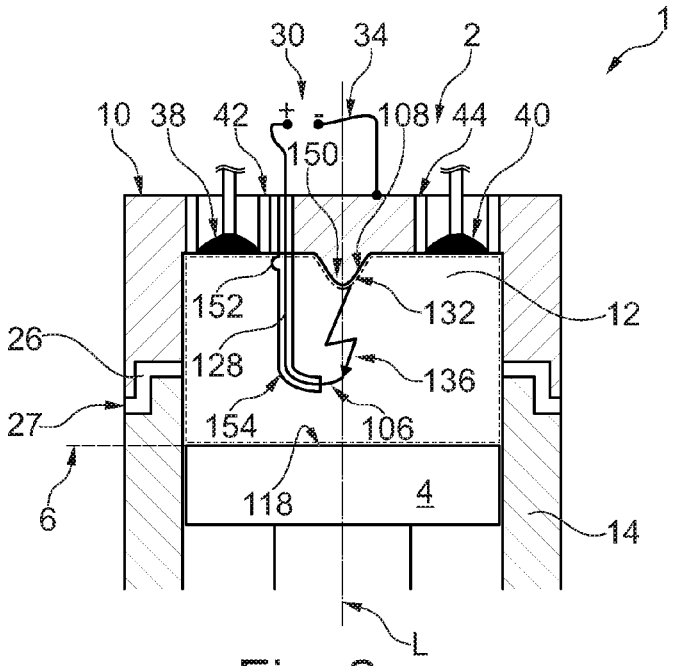
FIG. 2 is a schematic cross-sectional view of an ignition device with a supply line extending on the cylinder head electrode to the ignition chamber electrode, in accordance with a second embodiment of the invention.

In FIGS. 1 and 2, different exemplified embodiments of an ignition device 1 for an extraneously igniting combustion piston engine 2 is illustrated. In both exemplified embodiments, the piston 4 is shown at the top dead-centre 6 of its reciprocating movement along a movement axis L of the piston 4. A dead space remaining beyond the movement range of the piston 4 (along the axis L to an end face 8 of a cylinder head 10) is here designated as ignition chamber 12. The bounding of the ignition chamber 12 is shown in both exemplified embodiments by a double dashed chain line. In both exemplified embodiments, the piston 4 is guided with its outer surface exclusively on a cylinder body 14, not on the cylinder head 10.

FIG. 1 shows a first exemplified embodiment of the ignition device 1, in which the ignition chamber electrode 16 is formed to match an upper piston end surface 18 and is disposed in the proximity of a bounding surface 19 defined by the top dead-centre 6 of the piston 4.

It is clear from the cross-sectional illustration A-A that the ignition chamber electrode 16 is formed as a grid 20 and is fixed in the ignition chamber at two opposing sides on a respective isolating arm 22 and 24 respectively. The isolating arms 22 and 24 are formed as projections of a surrounding isolating ring 26 which is inserted at a connecting point 27 of the cylinder head 10 and cylinder body 14. The electric supply line 28 extends through the isolating arm 22 and the corresponding side of the isolating ring 26 from a voltage source 30 to the ignition chamber electrode 16. In this exemplified embodiment, the ignition chamber electrode is provided as a cathode, which is illustrated by the "+" which has been drawn in on the voltage surface 30.

The anode of the ignition device 1 is formed by a cylinder head electrode 32 which forms a part of the end surface 8 of the cylinder head 10. In the illustrated exemplified embodiment, the part formed as the cylinder head electrode 32 is formed to match both the corresponding part of the piston end surface 18 and also of the ignition chamber electrode 16. The cylinder head 10 formed from a conductive material is connected to the negative pole of the voltage source 30 by means of an electric supply line 34.

FIG. 1 shows the arrow 36 as an example for the large number of possible ignition gaps (with substantially the same distance x) between the cylinder head electrode 32 and the ignition chamber electrode 16.

An inlet valve 38 and an outlet valve 40 of the combustion piston engine 20 is electrically decoupled with respect to the cylinder head 10 by valve isolating rings 42 and 44.

By applying sufficient ignition voltage by means of the voltage source 30, an ignition spark is formed along the ignition gap 36 between the part, which is formed as a cylinder head electrode 32, of the end surface 8 of the cylinder head 10 and the grid 20 of the ignition chamber electrode 16, which ignition spark corresponds in its length at least to the distance between the electrodes with respect to the axis L and which therefore permits simultaneous initiation of the ignition in a clearly larger part of the ignition chamber 12 than would be the case e.g. in the case of a conventional spark plug. Nevertheless, in the illustrated embodiment, electrical isolation is possibly merely with non-moved isolating components (22, 24, 26, 42 and 44). For the sake of simplicity, isolation of the supply lines 28 and 34 outside the cylinder is not shown.

In the illustrated embodiment each point of the ignition chamber electrode 16 oriented towards the ignition gap 36 is at substantially the same distance x to a corresponding point of the cylinder head electrode 32. In this way the actual course of the ignition gap 36 (which is shown by way of example by arrow 36) can be determined by random factors such as e.g. a locally higher proportion of petrol in the petrol-air mixture and/or tolerances of a material formation on one or both electrodes.

A dashed line in FIG. 1 shows an alternative arrangement of the ignition chamber electrode 16 B. The ignition chamber electrode 16 B differs from the ignition chamber electrode 16 substantially in that it is disposed closer to the cylinder head electrode 32, which can be necessary e.g. in modern motor vehicle engines in order to achieve an efficient construction space arrangement of the engine. In order also in such a case to avoid the stroke of the valves 42 and 44 colliding with the electrode 16 B formed analogously to the electrode 16, apertures 46.1 and 46.2 are formed as the corresponding points, wherein the illustration in cross-section B-B is to be understood as not being to scale.

The embodiment of the ignition device 1 illustrated in FIG. 2 differs from that in FIG. 1 substantially in that the supply line 128 of the ignition chamber electrode 106 extends through the cylinder head electrode 132 and in that the ignition chamber electrode 106 is not formed to match either the piston end surface 118 or the end surface 108 of the cylinder head 10. A further difference is the design of the end surface 108 with a protrusion 150 which extends into the ignition chamber 12. Further features are provided analogously to the exemplified embodiment in accordance with FIG. 1 and are thus provided with the same reference numerals as in FIG. 1.

An isolating arm 154 is guided in a flush manner through the aperture 152 in the cylinder head 10 and extends along the axis L into the ignition chamber 12, through about ⅔ of the extent of the ignition chamber 12. At an ignition chamber-side end of the isolating arm 154, the ignition chamber electrode 106 protrudes out of this arm and, together with the protrusion 150 of the cylinder head electrode 132, forms a clearly defined ignition gap which is shown by the arrow 136. In contrast to the exemplified embodiment in accordance with FIG. 1, in this case the ignition gap 136 is formed by the minimal distance between the protrusion 150 and the tip of the ignition chamber electrode 106.

By guiding both electric supply lines 128 and 34 on the upper side of the cylinder head 10, a relatively simple isolation—requiring little construction space—of the supply lines 128 and 34 with respect to the surrounding area can be achieved. The cylinder body 14 is electrically decoupled from the cylinder head 10 by a simple isolating ring 26.

A suitable ceramic material or another material which is known per se to the person skilled in the art can be used as the material for the electrically isolating elements 22, 24, 26, 42, 44 and 128 in the described exemplified embodiments.

The invention claimed is:

1. Ignition device for an extraneously igniting combustion piston engine with an ignition chamber located between a cylinder head and a piston, wherein a cylinder head electrode is formed by at least a portion of the cylinder head, and wherein an ignition chamber electrode is disposed within the ignition chamber and forms an ignition gap with the cylinder head electrode; and wherein the ignition gap extends at least one quarter of the extent of the ignition chamber along a movement axis of the piston, wherein the ignition chamber electrode is connected to a high voltage source by a supply line disposed on the cylinder head and electrically isolated from the cylinder head and wherein the cylinder head electrode is in electrical communication with the cylinder head.

2. Ignition device as claimed in claim 1, wherein the end surface of the cylinder head, in the region of the cylinder head electrode, has a protrusion into the ignition chamber.

3. Ignition device as claimed in claim 1, wherein the ignition chamber electrode is immobile and disposed closer to the top dead center of the piston than it is to the cylinder head electrode.

4. Ignition device as claimed in claim 1, wherein the ignition chamber electrode is immobile and disposed at a bounding surface of the ignition chamber, which is defined by the top dead center of the piston.

5. Ignition device as claimed in claim 1, wherein the ignition chamber electrode is formed to match an upper piston end surface.

6. Ignition device for an extraneously igniting combustion piston engine with an ignition chamber located between a cylinder head and a piston, wherein a cylinder head electrode is formed by at least a portion of the cylinder head, and wherein an ignition chamber electrode is disposed within the ignition chamber and forms an ignition gap with the cylinder head electrode; and wherein the ignition gap extends at least one quarter of the extent of the ignition chamber along a movement axis of the piston, wherein the ignition chamber electrode is formed as a fluid-permeable and gas-permeable grid.

7. Ignition device as claimed in claim 6, wherein the ignition chamber electrode has at least one aperture for an inlet valve and/or an outlet valve of the internal combustion engine.

8. Ignition device as claimed in claim 1, wherein the ignition chamber electrode is formed to match the cylinder head electrode, wherein the ignition chamber electrode has a surface parallel and aligned with a surface of the cylinder head electrode, whereby each point on the surface of the ignition chamber electrode oriented toward the ignition gap is at substantially the same distance to a corresponding point of the cylinder head electrode.

9. Ignition device as claimed in claim 1, wherein the supply line of the ignition chamber electrode extends through the cylinder head electrode.

10. Ignition device for an extraneously igniting combustion piston engine with an ignition chamber located between a cylinder head and a piston, wherein a cylinder head electrode is formed by at least a portion of the cylinder head, and wherein an ignition chamber electrode is disposed within the ignition chamber and forms an ignition gap with the cylinder head electrode; and wherein the ignition gap extends at least one quarter of the extent of the ignition chamber along a movement axis of the piston, wherein a supply line of the ignition chamber electrode is disposed at a connecting point of the cylinder head and cylinder body.

11. A combustion piston engine having an ignition device as claimed in claim 1.

12. Ignition device as claimed in claim 1, wherein the movement axis is defined by a direction of mobility of the piston relative to the cylinder head.

13. Ignition device as claimed in claim 1, wherein the cylinder head electrode is integral with and stationary relative to the cylinder head.

14. Ignition device for an extraneously igniting combustion piston engine with an ignition chamber located between a cylinder head and a piston, wherein a cylinder head electrode is formed by at least a portion of the cylinder head, and wherein an ignition chamber electrode is disposed within the ignition chamber and forms an ignition gap with the cylinder head electrode; and wherein the ignition gap extends at least one quarter of the extent of the ignition chamber along a movement axis of the piston, wherein the ignition chamber electrode has a non-planar surface formed to match an upper piston end surface, which is non-planar.

* * * * *